US005098614A

United States Patent [19]

Yeh et al.

[11] Patent Number: 5,098,614

[45] Date of Patent: Mar. 24, 1992

[54] ADJUSTABLE BUBBLE BEND

[76] Inventors: Chiu-Tseng L. Yeh, 45, Hsin Ming St.; Pu-Chen Yeh, 62, Chung Hsing Road, both of Yang Mei, Taoyuan, Taiwan

[21] Appl. No.: 640,906

[22] Filed: Jan. 14, 1991

[51] Int. Cl.[5] ..... B01F 3/04

[52] U.S. Cl. ..... 261/64.1; 261/121.1; 261/DIG. 75; 261/71; 119/5

[58] Field of Search ..... 261/71, DIG. 75, 64.1; 119/5

[56] References Cited

U.S. PATENT DOCUMENTS

| | | | |
|---|---|---|---|
| 2,772,867 | 12/1956 | Cleckner | 119/5 |
| 3,146,195 | 8/1964 | Berardi | 119/5 |
| 3,485,373 | 12/1969 | Powers | 119/5 |
| 3,640,516 | 2/1972 | Willinger | 119/5 |
| 3,742,521 | 7/1973 | Bolgert et al. | 261/71 |
| 4,304,740 | 12/1981 | Cernoch | 119/5 |
| 4,842,727 | 6/1989 | Willinger et al. | 119/5 |

FOREIGN PATENT DOCUMENTS

| | | | |
|---|---|---|---|
| 1018023 | 9/1977 | Canada | 119/5 |
| 362730 | 9/1938 | Italy | 119/5 |
| 216173 | 5/1924 | United Kingdom | 119/5 |

*Primary Examiner*—Tim Miles

*Attorney, Agent, or Firm*—Morton J. Rosenberg; David I. Klein

[57] ABSTRACT

The present invention relates to an adjustment bubble bend. The structure of the adjustable bubble bend allows the user to control the volume of the bubbles produced by the device and to reduce the noise emitted from the device during operation.

1 Claim, 6 Drawing Sheets

ADJUSTABLE BUBBLE BEND

BACKGROUND OF THE INVENTION

For improving the interior view of a home, fish aquaria are often considered an essential decoration. However, because of the inadequacy of conventional air filters or bubble bends, water in an aquarium often becomes deoxygenated. Failure to supply the proper amount of oxygen to aquarium water will often result in the death of the fish contained therein. Conventional bubble bends suction water from the aquarium, filter the water, and then return the water to the aquarium with a small volume of fresh air.

SUMMARY OF THE INVENTION

It is a primary object of the present invention to provide an adjustable bubble bend for use in an aquarium for adding large amounts of air to the water filtered by the adjustable bubble bend.

Another object is to provide an adjustable bubble bend which has a unitary construction to achieve the advantages of quick assembly and endurance.

Another object is to provide an adjustable bubble bend which reduces the noise emitted from the bubble bend during operation.

Another object is to provide an adjustable bubble bend that allows the user to control the volume of air made available for filtering the aquarium, and to provide bubbles that resemble a natural waterfall to improve the aesthetic view of the aquarium.

These and other objects and advantages of the present invention will become apparent to those skilled in the art after considering the following detailed Specification together with the accompanying drawings.

DETAILED DESCRIPTION OF THE PREFERRED EMBODIMENTS

Figure 1:
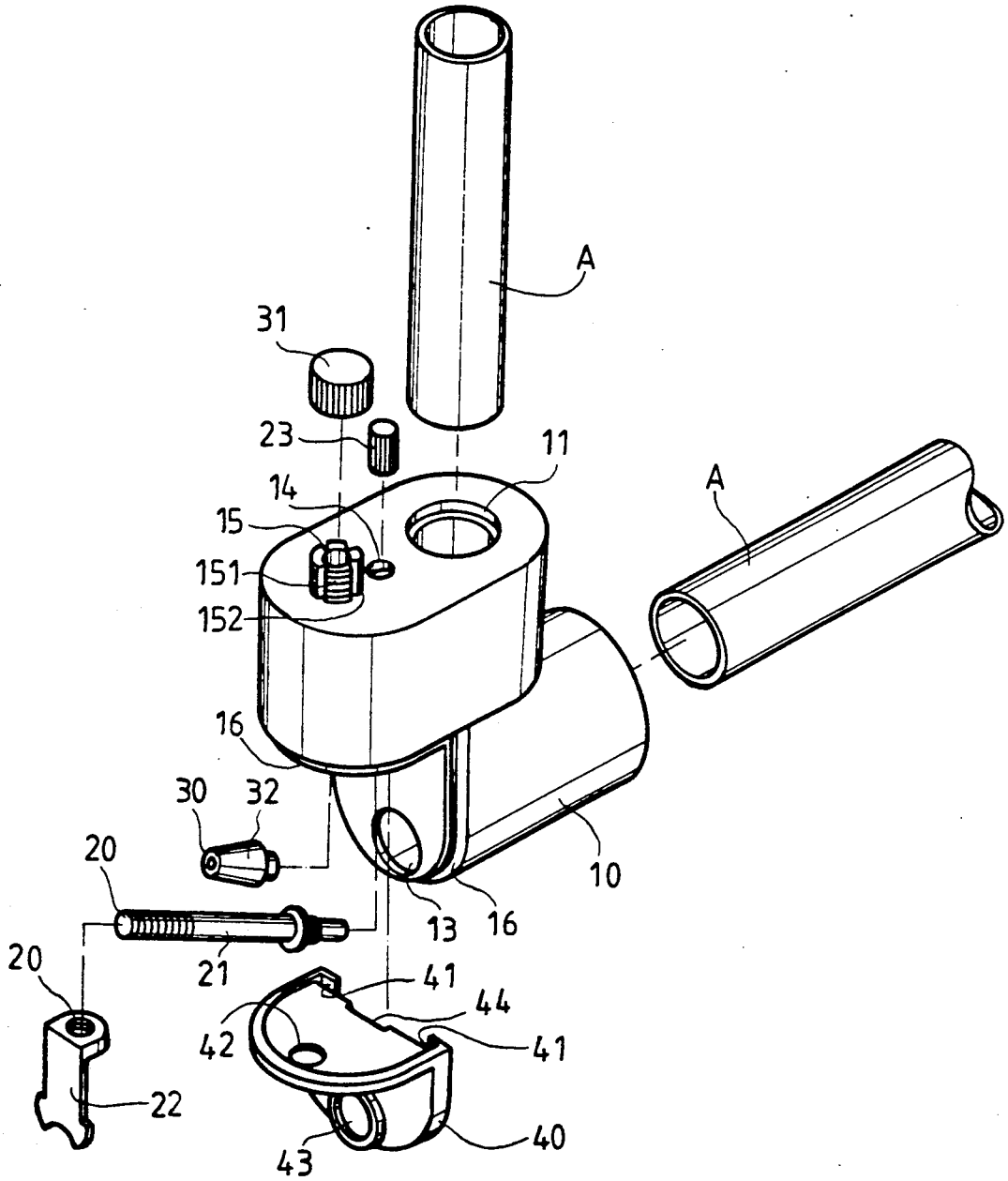
FIG. 1 is an elevational perspective view of the embodiment of the invention.
Figure 2D:
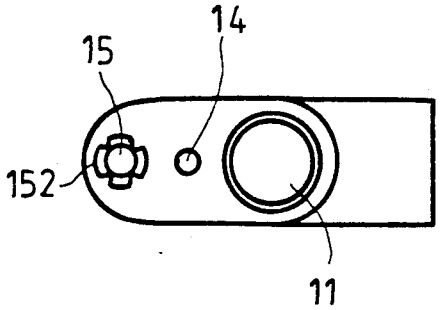
FIGS. 2A–2D are views of the body bent according to the embodiment of the invention.
Figure 2B:
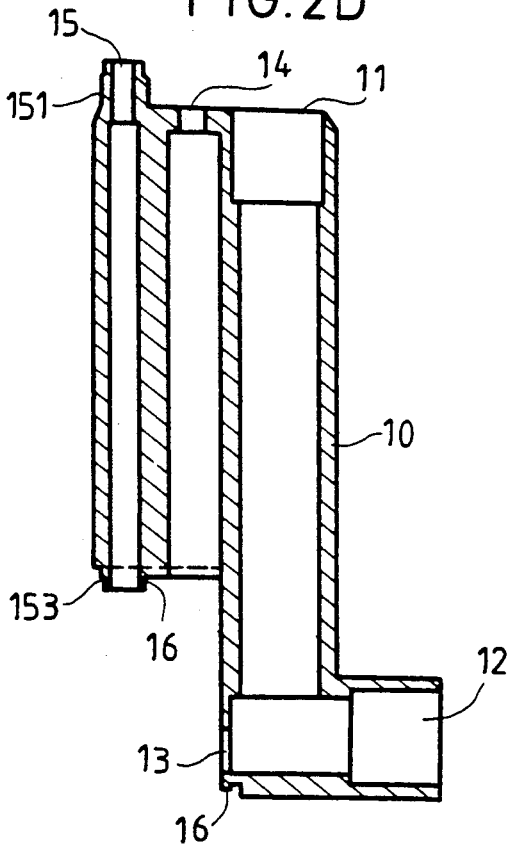
Figure 2C:
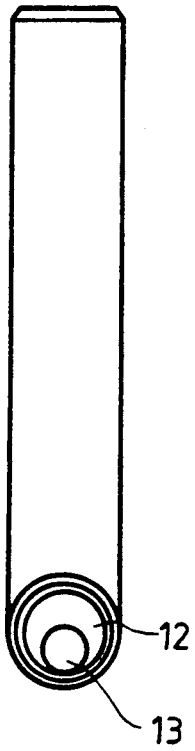
Figure 2A:
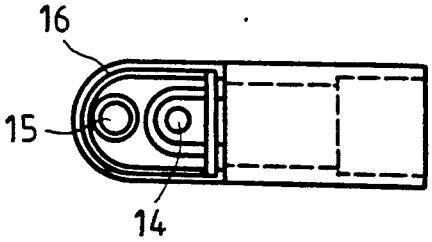
Figure 4B:
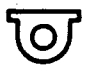
FIGS. 4A and 4B are views of the cover plate according to the embodiment of the invention.
Figure 4A:
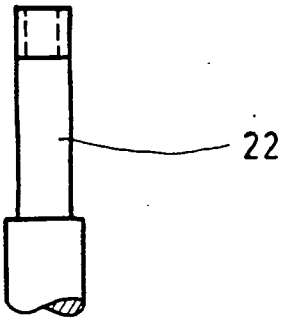
Figure 3:
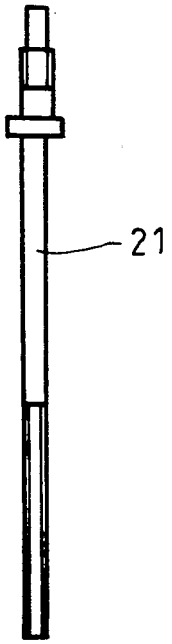
FIG. 3 is a sectional view of the gas screw according to the embodiment of the invention.
Figure 5B:
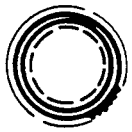
FIGS. 5A and 5B are views of the air adjusting button according to the embodiment of the invention.
Figure 5A:
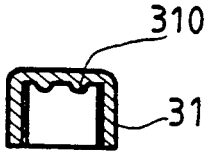
Figure 6B:
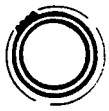
FIGS. 6A and 6B are views of the knob according to the embodiment of the invention.
Figure 6A:
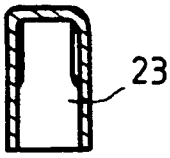
Figure 8A:
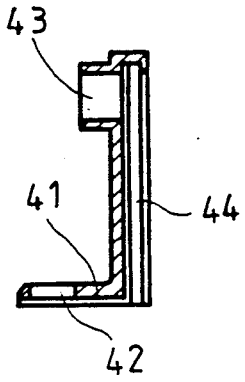
FIGS. 8A–8C are views of the seal cover according to the embodiment of the invention; and, FIG. 9 is a cross-sectional view of an assembled bubble bend according to the present invention.
Figure 8B:
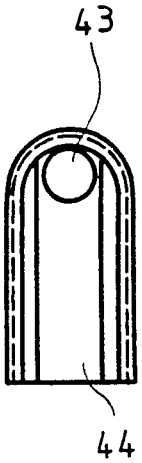
Figure 7:
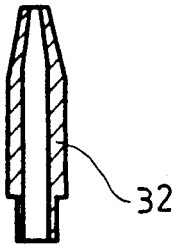
FIG. 7 is a sectional view of the air conduit according to the embodiment of the invention.
Figure 8C:
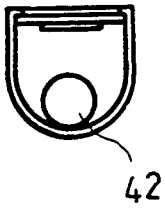
Figure 9:
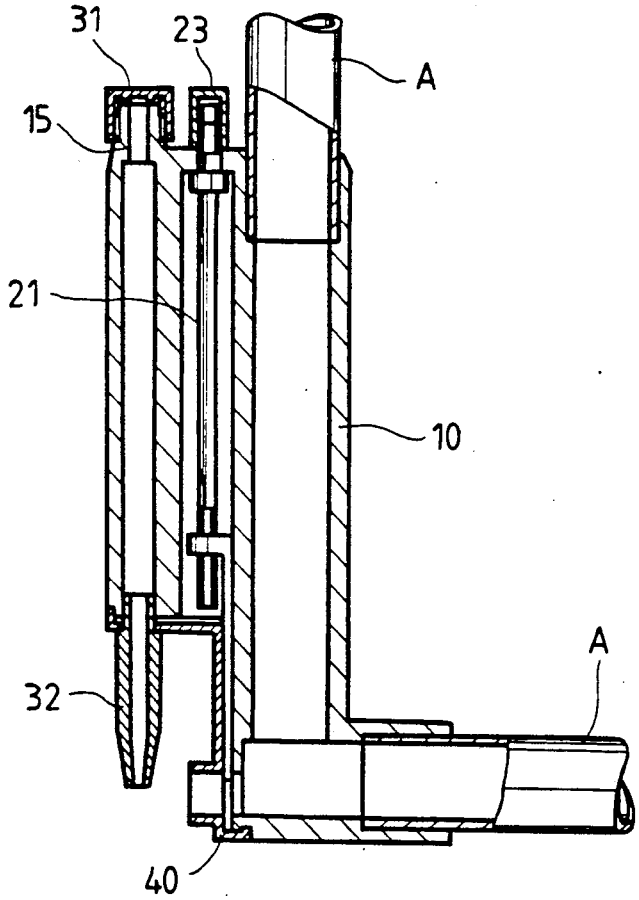

Referring to the Figures, the adjustable bubble bend comprises a bend body 10, a worm control device 20, an air control device 30, and an inverted L-type seal cover 40. Referring to FIGS. 1 and 2, bend body 10 is formed of a one-piece member having openings 11 and 12, which receive an upper straightway pipe or conduit A and a lower straightway pipe or conduit A that permits water flowing through the straightway pipe A to circulate by motor pumping. The opening 12 has a cover opening 13 and the upper end of body 10 is provided with upper and lower through openings 14 and 15, respectively. Upper and lower through openings receive the worm control device 20 and the air control device 30, respectively. The upper end of lower through hole 15 has a screw joint portion 151 to threadably receive an air adjustment button 31. The outer edge of the screw joint portion 151 has a plurality of longitudinal grooves which allows for a greater volume of air to flow into the lower through opening 15. The lower end of the lower through hole 15 has a setting member 153 for engaging an air conduit 32. A notch at the lower end of the bend body 10 is secured to a groove 16 of the inverted L-type seal cover 40.

Worm control device 20 includes a guide rod 21, a cover plate 22, and a knob 23 wherein said guide rod 21 extends through hole 14 of bend body 10 and is secured by the knob 23. Guide rod 21 rotates responsive to knob 23 rotation. The cover plate 22 is threaded at its upper end to threadably engage the threaded end of guide rod 21, which allows the guide rod 21 to move up and down responsive to a rotational displacement.

A control device 30 includes an air adjustor button 31 and an air conduit 32. The interior upper end of air adjustor button 31 is provided with a convex ring 310 for abutting the upper end face of screw joint portion 151. The abutting relationship of the convex ring 310 and the upper end face of screw joint portion 151 prevents air from entering the through hole 15 when the air adjustor button 31 is tightly engaged to the screw joint portion 151 of the bend body. When air adjustor knob 31 is unlocked, air is permitted to flow inside the through hole 15 and through the longitudinal grooves 152 at the outer edge of the screw joint portion, the convex ring 310, and the crevice at the upper end face of the screw joint portion. Air conduit 32 is secured to the setting member 153 of bend body 10 to communication with the through hole 15 for forming an air passage.

The inverted L-type seal cover 40 is provided with a rail channel 41, along its outer edge which it engages. The rail channel 41 receives the rail of groove 16 on the notch provided on the lower end of bend body 10. The engagement of the rail channel 41 and the rail groove 16 allows the L-type seal cover 40 to be securely affixed to the bend body 10. The upper end of the seal cover is provided with an opening 42 to communicate with through opening 15 of the bend body 10 and receives the lower end of air conduit 32. The mounting of air conduit 32 and the opening 42 not only enables the inverted L-type seal cover 40 and the bend body to be more securely affixed, but also enables the air conduit 32 to be more securely retained in opening 42. The lower end of the seal cover 40 is provided with a through opening 43 disposed opposite the cover opening 13 of through opening 12 of the bend body 10. The frontal edge of the seal cover 40 extends forwardly to air conduit 32 to make siphonage more effective. The joint portion between the seal cover 40 and bend body 10 has a rail groove 44 with a cover plate 22 to enable the cover plate 22 to move vertically.

To assemble, the upper and lower straightway pipes A are inserted into the through openings 11 and 12, respectively, and the guide rod 21 is inserted into the through opening 14. The cover plate 22 is threaded onto the lower threaded portion of the guide rod 21 and the knob 23 is threaded onto the upper end of the guide rod 21. The rail 16 of the notch provided on the lower end of the bend body is received by the rail channel 41 on the seal cover 40 to securely affix the bend body 10 to the seal cover 40. Air conduit 32 is mounted onto the setting member 153 of the bend body 10, and the air ingestor button 31 is threaded onto the joint member 151 of the bend body 10.

A motor will pump water into the lower straightway pipe A through openings 11 and 12, and into the upper straightway pipe A. Water exiting from the upper straightway pipe A will return to the aquarium. By means of the worm control device 20, the cover plate 22 will move vertically to open or close the opening 13 in order to regulate water flow volume and to generate a suction force for allowing a large amount of air to flow through the air conduit and for producing a great amount of bubbles at the opening of the air conduit. Additionally, bubble vibration may cause water wave and to generate a convection effect in the aquarium, whereby the heat produced by a heater can spread uniformly throughout the aquarium. The amount of bubbles produced depends on the volume of water flow at the cover opening 13 controlled by the air adjustor 31 and the cover plate 22. By rotating the adjusting knob 31, the spacing between the convex ring 310 at the upper end of the interior of knob 31 on the top end or the upper end of the screw joint portion will change to control the amount of air flow and the noise emitted by the adjustable bubble bend.

We claim:

1. An adjustable bubble bend comprising and being characterized:

a bend body being one-piece formed, including three communicated holes, i.e. leftward, rightward and upper holes, the end face of said leftward hole having formed a cover opening and having a cover through hole thereon made in certain size subject to actual requirement; upper end of bend body having upper and lower through holes provided in convenience for mounting worm control device and air control device; upper end of said air control device having a screw joint portion with a notch, and lower end having a setting portion, and the notch at bottom end of bend body having a rail groove for setting with a seal cover; and a worm control device including a guide rod, a cover plate and knob, upper and lower ends of said guide rod having a thread portion respectively, and upper end being provided to screw with the knob, lower end being provided to screw with the cover plate and being mounted at bend body to control the cover plate moving up and down reciprocatingly; and an air control device including an air adjuster knob and air conduit wherein the top at the inner end of said air adjuster button having a convex ring being screwed at screw joint portion at upper end of through hole of bend body, said air conduit being inserted at the setting portion at lower end; and a seal cover resembling an inverted L shape and outer edge having a rail groove fitting the rail groove of notch at lower end of bend body to enable the seal cover be fully set at the bend body, and upper end having a hole provided to mount with air conduit being opposite against the through hole of bend body and further to enable seal cover be set with the bend body more securely, lower end having a hole communicating with the cover opening of bend body, and frontal edge being extending forward near the bottom side of air conduit, and joint portion of seal cover with bend body having a cover rail groove;

said worm control device being mounted in the through hole at upper end of bend body and provided to enable the cover plate to move up and down along the cover rail groove between seal cover and bend body by means of the knob at upper end of guide rod in order to control the size of cover opening and to control the amount of water flow, and size of cover opening being permitted to be designed at random, and cover opening being not eccentric with the cover plate, said bend body being one-piece formed, the convex ring on the top at inner end of said air adjuster knob being permitted to match the notch of screw joint portion of bend body to control the volume of air fed as well as to reduce the noise.

* * * * *